US010207324B2

(12) United States Patent
Yan

(10) Patent No.: US 10,207,324 B2
(45) Date of Patent: Feb. 19, 2019

(54) METHOD FOR MANUFACTURING PARTS WITH BUILT-IN CHANNEL

(71) Applicant: NINGHAI DAYA PRECISION MACHINERY CO., LTD, Ningbo, Zhejiang (CN)

(72) Inventor: Weifa Yan, Zhejiang (CN)

(73) Assignee: NINGHAI DAYA PRECISION MACHINERY CO., LTD., Ningbo (CN)

( * ) Notice: Subject to any disclaimer, the term of this patent is extended or adjusted under 35 U.S.C. 154(b) by 337 days.

(21) Appl. No.: 15/232,838

(22) Filed: Aug. 10, 2016

(65) Prior Publication Data

US 2017/0326644 A1 Nov. 16, 2017

(30) Foreign Application Priority Data

May 11, 2016 (CN) ..... 2016 1 0326005

(51) Int. Cl.

| | |
|---|---|
| ***B22F 3/00*** | (2006.01) |
| ***B22F 3/04*** | (2006.01) |
| ***B22F 3/10*** | (2006.01) |
| ***B22F 3/15*** | (2006.01) |
| ***B22F 5/10*** | (2006.01) |

(52) U.S. Cl.

CPC ..... *B22F 3/10* (2013.01); *B22F 3/004* (2013.01); *B22F 3/005* (2013.01); *B22F 3/04* (2013.01); *B22F 3/15* (2013.01); *B22F 5/10* (2013.01); *B22F 2201/01* (2013.01); *B22F 2201/20* (2013.01); *B22F 2998/10* (2013.01)

(58) Field of Classification Search

None

See application file for complete search history.

(56) References Cited

U.S. PATENT DOCUMENTS 7,776,255 B1 * 8/2010 Wedding ..... B22F 1/0051 419/29

FOREIGN PATENT DOCUMENTS

| | | | |
|---|---|---|---|
| CN | 102802845 A | | 11/2012 |
| CN | 104099489 A | | 10/2014 |
| JP | 10158703 A | * | 6/1998 |
| JP | H10158703 A | | 6/1998 |
| TW | 201103667 A | | 2/2011 |

OTHER PUBLICATIONS

1st Office Action of counterpart Taiwanese Patent Application No. 105125991 dated May 24, 2017.

1st Office Action of counterpart Japanese Patent Application No. 2016-161288 dated Jul. 25, 2017.

* cited by examiner

*Primary Examiner* — Anthony J Zimmer

(57) ABSTRACT

This invention provides a method for manufacturing parts with a built-in channel. Two kinds of materials with different melting points are used, the material with the lower melting point is a molding element with an arbitrary shape, the material with the higher melting point is powdered, and the material with the low melting point is wrapped and positioned in the powder with the high melting point. When the preparation is completed, the low-temperature material is melted down, and the channel with the random shape is formed after sintering. In the application that the metal parts need supply water, air, or oil, instead of the channel acquired by mechanical splicing or the channel molded by 3D printing technology, this method in the invention is with a wide application range, the lower cost, and the simple and controllable technology, and is suitable for mass production and with very broad market prospects.

8 Claims, No Drawings

METHOD FOR MANUFACTURING PARTS WITH BUILT-IN CHANNEL

CROSS REFERENCE TO RELATED APPLICATIONS

The present application claims the benefit of Chinese patent application No. 201610326005.2 filed on May 11, 2016, all the contents of which are hereby incorporated by reference.

BACKGROUND OF THE INVENTION

Field of the Invention

The invention relates to industrial field and, more particularly, to a method for manufacturing parts with a built-in channel, capable of forming a product with a complex channel structure.

Description of the Related Art

In water, oil, and gas supply filed of machinery industry, metal parts with a channel are widely used, such as a channel for feeding gas and oil and a cooling channel in a suspension bearing system, a cooling water channel of an insert, a gate sleeve, a slide in a mechanical mold, and different application in the machinery industry where a directional and site-directed built-in channel structure is needed. Generally, a method for designing a built-in channel is to seal via a sealing ring after splicing, or a method of welding and fixing after splicing is adopted. The production process of the design is complex, generally can only solve a channel with a 2D structure, the reliability and security is poor, and the maintenance cost is high. The metal parts with the complex built-in channels have a wide range of applications and market prospects. Therefore, the method for forming the metal parts with the built-in complex channel is needed by the industry.

BRIEF SUMMARY OF THE INVENTION

The invention is to provide a method for manufacturing parts with a built-in channel, with advantages of reliable use, better safety, and low maintenance cost.

This invention provides a method for manufacturing parts with a built-in channel, and the method includes the following steps:

step 1.1, forming a channel structure with a needed channel shape;

step 1.2, coating a protective film on a surface of the channel structure;

step 1.3, positioning the channel structure in a mold cavity for forming the part, and filling powder for forming the part, wherein a melting point of the channel structure is lower than a melting point of the powder for forming the part;

step 1.4, melting down the channel structure;

step 1.5, sintering to form the part with the built-in channel.

In the step 1.1, the channel structure for forming the channel shape may be a metal material, paraffin, or resin, with a melting point of 0~500° C.

In the step 1.1, the molding method of the channel structure may be one or any combination of welding, casting, injection, and 3D molding.

In the step 1.2, a material of the protective film coated on the surface of the channel structure may be one or any combination of PVP, PVA and talc powder.

In the step 1.3, a supporting structure with the same material as the formed part may be used in the positioning method.

The filling method of the high-temperature metal powder may be mechanical pressing, injection molding, slurry filling, cold isostatic pressing, or hot isostatic pressing.

In the step 1.3, the powder for forming the part may be metal powder or a ceramic molding material with a melting point higher than 600° C.

In the step 1.5, the channel structure may be melted down by a method of heating under atmosphere pressure or heating under a vacuum.

In the step 1.4, the channel structure may be removed by a skim method.

In the step 1.5, the sintering may be performed in a vacuum.

The sintering may be performed in the vacuum with reducing atmosphere.

The invention has the following beneficial effects. Through the method for manufacturing parts with a built-in channel, an integrally formed part (metal) with the built-in channel can form the complex shape of a 3D structure. Since the part is integrally formed, except the maintenance cost, the reliability, safety and the mechanical strength of the part is very high, and the part especially with a substrate made of refractory metal materials has obvious advantages. This invention may also be applied to mold a built-in complex channel on non-metallic materials such as ceramic.

DETAILED DESCRIPTION OF THE INVENTION

A method for manufacturing parts with a built-in channel is characterized in that the method includes the following steps:

step 1.1, forming a channel structure with a needed channel shape;

step 1.2, coating a protective film on a surface of the channel structure;

step 1.3, positioning the channel structure in a mold cavity for forming the part, and filling powder for forming the part, wherein a melting point of the channel structure is lower than a melting point of the powder for forming the part;

step 1.4, melting down the channel structure;

step 1.5, sintering to form the part with the built-in channel.

In the step 1.1, the channel structure for forming the channel shape is a metal material, paraffin, or resin, with a melting point of 0~500° C. In the embodiment, a metal material is used.

In the step 1.1, the molding method of the channel structure is one or any combination of welding, casting, injection, and 3D molding.

In the step 1.2, a material of the protective film coated on the surface of the channel structure is one or any combination of PVP, PVA and talc powder, thus to be convenient for removing the channel structure and ensure the smoothness of the channel, and to avoid adverse reactions of the two kinds of materials under high-temperature sintering and to enhance the surface hardness of the channel structure.

In the step 1.3, a supporting structure with the same material as the formed part is used in the positioning method.

In the step 1.3, the filling method of the high-temperature metal powder is mechanical pressing, injection molding, slurry filling, cold isostatic pressing, or hot isostatic pressing.

In the step 1.3, the powder for forming the part is metal powder or a ceramic molding material with a melting point higher than 600° C.

In the step 1.4, the channel structure is melted down by a method of heating under atmosphere pressure.

In the step 1.4, the channel structure is melted down by a method of heating under a vacuum.

In the step 1.4, the channel structure is removed by a skim method.

In the step 1.5, the sintering is performed in a vacuum.

In the step 1.5, the sintering is performed in the vacuum with reducing atmosphere.

In the method for manufacturing parts with a built-in channel in the invention, two kinds of materials with different melting points are used, the material with the lower melting point is a molding element with an arbitrary shape, the material with the higher melting point is powdered, and the material with the low melting point is wrapped and positioned in the powder with the high melting point. When the preparation is completed, the low-temperature material is melted down, and the channel with the random shape is formed after sintering. In the application that the metal parts need supply water, air, or oil, instead of the channel acquired by the mechanical splicing method or the channel molded by 3D printing technology with the higher cost, this method in the invention is with a wide range of applications, the lower cost, and the simple and controllable technology, and this method in the invention is suitable for mass production and is with very broad market prospects.

What is claimed is:

1. A method for manufacturing parts with a built-in channel, comprising:

step 1.1, forming a channel structure;

step 1.2, coating a protective film on a surface of the channel structure;

step 1.3, positioning the channel structure in a mold cavity for forming the part, and filling powder for forming the part, a melting point of the channel structure being lower than a melting point of the powder for forming the part;

step 1.4, melting down the channel structure;

step 1.5, sintering to form the part with the built-in channel;

wherein, in the step 1.2, a material of the protective film coated on the surface of the channel structure is one or any combination of PVP and PVA.

2. The method for manufacturing parts with a built-in channel according to claim 1, characterized in that, in the step 1.1, the channel structure is a metal material, paraffin, or resin, with a melting point of 0~500° C., and in the step 1.1, the molding method of the channel structure is one or any combination of welding, casting, injection, and 3D molding.

3. The method for manufacturing parts with a built-in channel according to claim 1, characterized in that, in the step 1.3, a supporting structure with the same material as the formed part is used in the positioning method.

4. The method for manufacturing parts with a built-in channel according to claim 1, characterized in that, the filling method of the high-temperature metal powder is mechanical pressing, injection molding, slurry filling, cold isostatic pressing, or hot isostatic pressing.

5. The method for manufacturing parts with a built-in channel according to claim 1, characterized in that, in the step 1.3, the powder for forming the part is metal powder or a ceramic molding material with a melting point higher than 600° C.

6. The method for manufacturing parts with a built-in channel according to claim 1, characterized in that, in the step 1.5, the channel structure is melted down by a method of heating under atmosphere pressure or heating under a vacuum.

7. The method for manufacturing parts with a built-in channel according to claim 1, characterized in that, in the step 1.5, the sintering is performed in a vacuum.

8. The method for manufacturing parts with a built-in channel according to claim 7, characterized in that the sintering is performed in the vacuum with reducing atmosphere.

* * * * *